United States Patent [19]

Higashiyama

[11] 4,276,866

[45] Jul. 7, 1981

[54] COMPUTER-CONTROLLED EXHAUST GAS RECIRCULATION SYSTEM FOR INTERNAL COMBUSTION ENGINE

[75] Inventor: Kazuhiro Higashiyama, Atsugi, Japan

[73] Assignee: Nissan Motor Company, Limited, Japan

[21] Appl. No.: 97,386

[22] Filed: Nov. 26, 1979

[30] Foreign Application Priority Data

Dec. 6, 1978 [JP] Japan ..... 53-151443

[51] Int. Cl.[3] ..... F02B 47/08; F02M 25/06

[52] U.S. Cl. ..... 123/571

[58] Field of Search ..... 123/571

[56] References Cited

U.S. PATENT DOCUMENTS

| | | | |
|---|---|---|---|
| 4,153,013 | 5/1979 | Bianchi et al. | 123/571 |
| 4,161,162 | 7/1979 | Latsch et al. | 123/571 |
| 4,161,929 | 7/1979 | Nohira et al. | 123/571 |
| 4,164,032 | 8/1979 | Nohira et al. | 123/571 |
| 4,164,206 | 8/1979 | Toelle | 123/571 |
| 4,166,437 | 9/1979 | Bianchi et al. | 123/571 |
| 4,170,973 | 10/1979 | Nohira et al. | 123/571 |
| 4,171,691 | 10/1979 | Nohira et al. | 123/571 |
| 4,173,205 | 11/1979 | Toelle | 123/571 |

FOREIGN PATENT DOCUMENTS

| | | | |
|---|---|---|---|
| 54-135929 | 10/1979 | Japan | 123/571 |
| 54-137521 | 10/1979 | Japan | 123/571 |

*Primary Examiner*—Wendell E. Burns

*Attorney, Agent, or Firm*—Lane, Aitken, Ziems, Kice & Kananen

[57] ABSTRACT

In an internal combustion engine having an exhaust recirculation system including a combination of a vacuum-operated recirculation rate control valve and a solenoid-operated vacuum compensating valve, the vacuum compensating valve is controlled by pulse signals delivered from a microcomputer responsive to predetermined operational parameters, such as the revolution speed of the engine and the load on the engine, for modifying the pulse signals depending upon, for example, the accelerating and non-accelerating conditions of the engine.

11 Claims, 3 Drawing Figures

COMPUTER-CONTROLLED EXHAUST GAS RECIRCULATION SYSTEM FOR INTERNAL COMBUSTION ENGINE

FIELD OF THE INVENTION

The present invention relates to an exhaust gas recirculation system for an automotive internal combustion engine and, more particularly, to control means for use in such an exhaust gas recirculation system.

BACKGROUND OF THE INVENTION

One of the forerunning types of exhaust gas recirculation systems for automotive internal combustion engines uses a microcomputer for the control of the exhaust gas recirculation rate. In an exhaust gas recirculation system of this type, the exhaust gas recirculation rate is varied through detection of the revolution speed of the engine and the load on the engine. The detected engine revolution speed and engine load are converted into electric signals as variable input signals for the microcomputer. In response to these signals, the microcomputer selects out of the table data preliminarily stored therein an optimum exhaust gas recirculation rate for the engine revolution speed and engine load represented by the signals.

During constant-speed operating conditions of an internal combustion engine, the relationship between the revolution speed of the engine and the load applied to the engine varies curvilinearly from a point corresponding to an idling condition of the engine, describing a curve which is commonly called the road-load curve and which is contained in a certain region in the load-revolution speed characteristics of the engine. Under accelerating and decelerating conditions of the engine, the load-revolution speed characteristics of the engine respectively vary within regions which are separate from each other across the constant-speed region.

As is well known in the art, furthermore, internal combustion engines tend to produce more nitrogen oxides during acceleration of the engine than under other operating conditions of the engine. For the reduction of the concentration of nitrogen oxides to be emitted from an automotive internal combustion engine, it is advantageous to recirculate more exhaust gases under accelerating conditions of the engine than during other modes of operation of the engine.

In a conventional computer-controlled exhaust gas recirculation system, the exhaust gas recirculation rate is controlled in such a manner as to be increased and decreased in response to the acceleration and constant speed regions, respectively, of the load-revolution speed characteristics of the engine.

During acceleration on a level road surface, the load-revolution characteristics of the engine follow the above mentioned road-load curve and are thus shifted from the acceleration region to the constant-speed region of the characteristics in a comparatively short while. During hill-climbing of the vehicle, on the other hand, the load-revolution speed characteristics of the engine stay within the acceleration region thereof. Under these conditions, the engine tends to overheat and would therefore cause troubles if exhaust gases are recirculated at rates which are optimum for the accelerating conditions of the engine. There are various other reasons for which it is desired to reduce the exhaust recirculation rate during hill-climbing of a vehicle as compared with the recirculation rate desired for the accelerating conditions of the engine, as will be discussed later.

The present invention contemplates provision of an exhaust gas recirculation system featuring control means suitable for eliminating these drawbacks which have thus far beed inherent in conventional computer-controlled exchaust gas recirculation systems for automotive internal combustion engines.

SUMMARY OF THE INVENTION

In accordance with the present invention, there is provided in an internal combustion engine having an air-fuel mixture supply system, an exhaust system and an exhaust gas recirculation system including exhaust gas recirculation passageway means for providing communication between the exhaust system and the mixture supply system, and valve means operative to vary the recirculation rate of exhaust gases through the passageway means depending upon a signal supplied to the valve means, the improvement comprising detecting means for detecting prescribed operational parameters of the engine and producing signals representative of the detected operational parameters, and control means comprising a decision circuit responsive to the signals from the detecting means for producing either of signals respectively representative of at least two predetermined load conditions of the engine, a timer circuit responsive to a predetermined one of the signals from the decision circuit for producing an output signal for a period of time related to the time duration of the predetermined one of the signals from the decision circuit, and control signal delivery means responsive to the signals from the detecting means and the signal from the timer circuit for supplying to the aforesaid valve means a control signal dictated by the signals from the detecting means and corrected by the signal from the timer circuit.

The control signal delivery means may comprise a memory circuit having stored therein a collection of data representative of desired exhaust gas recirculation rates in terms of the prescribed operational parameters of the engine, the memory circuit being operative to produce an output signal representative of one of such data in response to the signals from the detecting means. In this instance, the control signal delivery means may further comprise a correction circuit responsive to the output signal from the above mentioned memory circuit for correcting the signal from the memory circuit in the presence of the signal from the aforesaid timer circuit.

The above mentioned memory circuit may be arranged so that the table data stored therein are representative of maximum desired exhaust gas recirculation rates in terms of the aforesaid prescribed operational parameters of the engine. In this instance, the decision circuit may be operative to produce a signal representative of a predetermined accelerating range of the operating conditions of the engine and a signal representative of a predetermined non-accelerating range of the engine operating conditions, the timer circuit being responsive to the signal representative of the accelerating range of the engine operating conditions, the correction circuit being operative to modify the output signal from the memory circuit depending upon the presence and absence of the signal from the timer circuit.

BRIEF DESCRIPTION OF THE DRAWINGS

The features and advantages of an exhaust gas recirculation system according to the present invention will be more clearly appreciated from the following description taken in conjunction with the accompanying drawings, in which.

DETAILED DESCRIPTION OF THE EMBODIMENT

Figure 1:
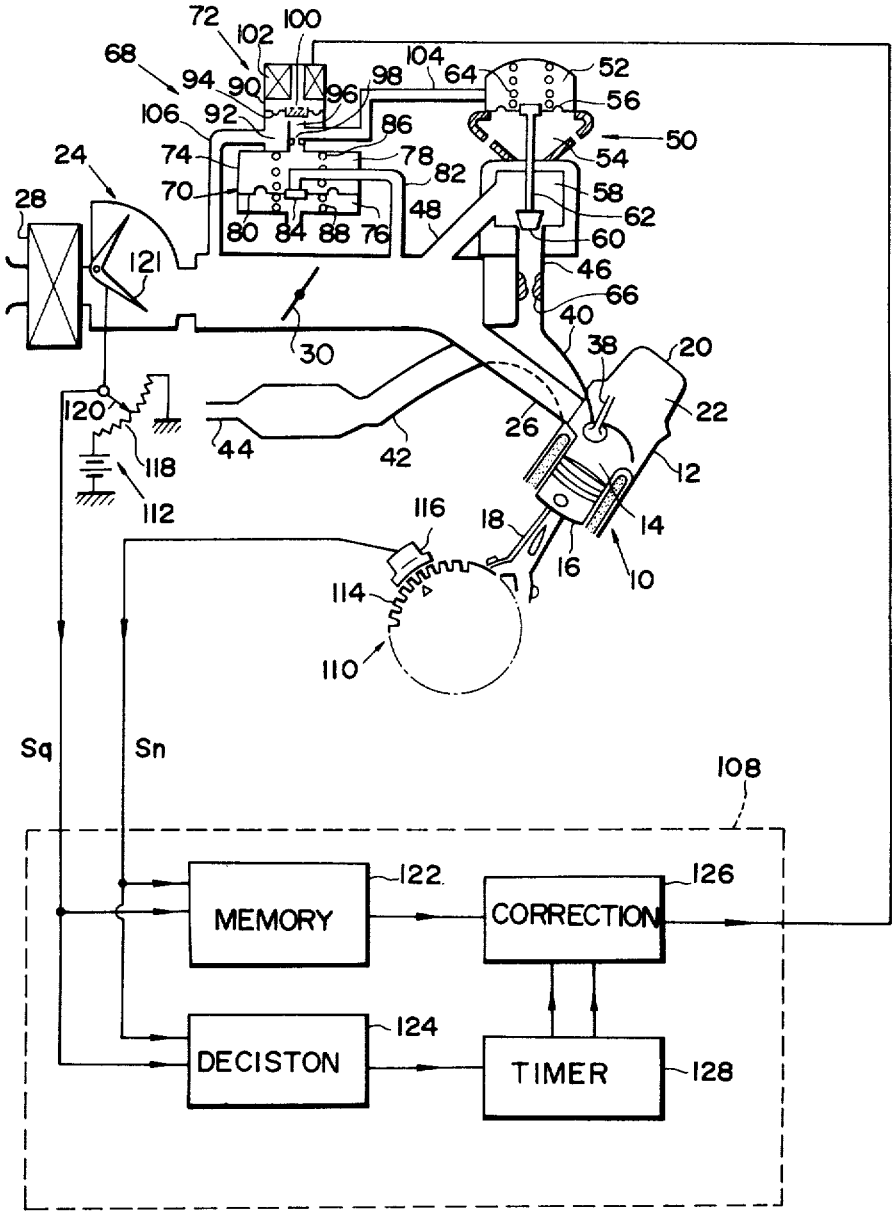
FIG. 1 is a schematic view showing, largely in section, a preferred embodiment of the exhaust gas recirculation system according to the present invention.

Referring to FIG. 1 of the drawings, an automotive internal combustion engine equipped with an exhaust gas recirculation system is schematically shown comprising a power cylinder 10 having a cylinder block 12 formed witn a cylinder bore 14. A reciprocating piston 16 is axially movable back and forth in the cylinder bore 14 and is coupled to an engine crankshaft (not shown) by a connecting rod 18. The cylinder block 12 is topped by a cylinder head 20 defining a variable-volume combustion chamber 22 between the cylinder head 20 and the upper face of the reciprocating piston 16.

The internal combustion engine incorporating the improvement according to the present invention is assumed to be of the fuel injection type by way of example and, thus, further comprises an air-fuel mixture supply system largely consisting of an air intake assembly 24 and an intake manifold 26 leading from the air intake assembly 24 to the power cylinders 10 of the engine. The air intake assembly 24 includes an air cleaner 28 open to the atmosphere and a throttle valve 30 positioned downstream of the air cleaner 28 and upstream of the intake manifold 26. The intake manifold 26 has provided therein electrically operated fuel injection valves (not shown) each adapted to inject fuel into each of the intake ports or directly into each of the power cylinders 10 of the engine. If desired, the fuel injection valves which are herein assumed to be provided respectively for the individual power cylinders may be substituted by a single fuel injection valve (not shown) which is common to all of the power cylinders or to two or more groups of the power cylinders. The throttle valve 30 is linked to an accelerator pedal (not shown) of an automotive vehicle for being moved between a fully open position and a minimum open or idling position as the accelerator pedal is depressed.

The intake manifold 26 leading from the carburetor 24 thus constructed generally consists essentially of a plurality of induction passageways each of which is communicable with the combustion chamber 22 of the power cylinder 10 across an intake valve 38 provided in, for example, the cylinder head 20.

The combustion chamber 22 of the power cylinder 10 in turn is communicable across an exhaust valve (not shown) with an exhaust system which is shown comprising an exhaust manifold 40 connected to the power cylinder 10, and exhaust pipe 42 leading from the exhaust manifold 40 and having a muffler or mufflers (not shown) provided therein, and a tail pipe 44 leading from the exhaust pipe 42 and open to the atmosphere at its leading end. The mixture supply system and the exhaust system of an automotive internal combustion engine being well known per se, description regarding the details of the construction and operation of such systems will not be herein incorporated to avoid prolixity of description.

In accordance with the present invention, the internal combustion engine thus constructed and arranged is provided with an exhaust gas recirculation system which comprises an exhaust gas recirculation passageway 46 leading from a suitable portion such as, for example, the exhaust manifold 40 as shown of the exhaust system and an exhaust gas feed passageway 48 leading to the mixture supply system downstream of the throttle valve 30 as shown of the mixture supply system. Between the exhaust gas recirculation passageway 46 and the exhaust gas feed passageway 48 thus arranged is provided a vacuum-responsive exhaust recirculation rate control valve assembly 50 adapted to control the recirculation rate of exhaust gases to the mixture supply system depending upon a vacuum developed in the mixture supply system downstream of the throttle valve 30.

The recirculation rate control valve assembly 50 comprises a valve casing internally divided into a variable-volume vacuum chamber 52 and a variable-volume atmospheric chamber 54 by a flexible diaphragm 56 which is secured along its perimeter to the valve casing. The atmospheric chamber 54 is open to the atmosphere through openings formed in the valve casing so that an atmospheric pressure is at all times developed in the atmospheric chamber 54. The valve casing is further formed with a valve chamber 58 which is constantly open to the exhaust gas feed passageway 48 and is communicable with the exhaust gas recirculation passageway 46 across a generally frusto-conical valve element 60 which is axially movable into and out of a position seated on a valve seat wall forming part of the valve casing. The valve element 60 is secured to an elongated valve stem 62 at one end of the valve stem 62 which is secured at the other end thereof to the diaphragm 56 between the vacuum and atmospheric chambers 52 and 54. The valve stem 62 extends through the atmospheric chamber 54 into the valve chamber 58 and is axially movable with the diaphragm 56 with respect to the valve casing so that the valve element 60 carried by the valve stem 62 is axially movable into and out of the above mentioned position closing the exhaust gas recirculation passageway 46. The valve element 60 is urged to move toward such a position by suitable biasing means which is shown comprising a preloaded helical compression spring 64 positioned within the vacuum chamber 52 and seated at one end of the diaphragm 56 and at the other end on an internal surface portion of the valve casing. The exhaust gas recirculation passageway 46 is shown provided with a flow restriction of orifice 66.

The exhaust gas recirculation system according to the present invention further comprises a vacuum compensating valve assembly 68 which largely consists of a series combination of a diaphragm-operated vacuum regulator valve unit 70 and a solenoid-operated vacuum modifier valve unit 72. The diaphragm-operated vacuum regulator valve unit 70 is adapted to develop a constant vacuum and comprises a valve casing 74 which is internally divided into a variable-volume atmospheric chamber 76 and a variable-volume vacuum chamber 78 by a flexible diaphragm 80 separating the chambers 76 and 78 from each other and secured along its perimeter to the valve casing 74.

An input vacuum passageway 82 leads from a suitable portion of the mixture supply system downstream of the throttle valve 30 and is open at its leading end into the vacuum chamber 78 of the vacuum regulator valve unit 70, the leading end of the passageway being open toward the diaphragm 80 as shown. The diaphragm 80 has securely attached thereto a generally disc-shaped valve element 84 which projects into the vacuum chamber 78 and which is axially movable with the diaphragm 80 into and out of a position closing the input vacuum passageway 82 at the leading end of the passageway. The valve element 84 is urged to move away from such a position thereof by suitable biasing means such as a preloaded helical compression spring 86 which is positioned within the vacuum chamber 78 and which is seated at one end on the diaphragm 80 and at the other end on one end wall portion of the valve casing 74. If desired, a compensating or calibrating spring 88 may be provided within the atmospheric chamber 76 so as to compensate or minutely calibrate the force thus urging the valve element 84 to move away from the position closing the input vacuum passageway 82. The atmospheric chamber 76 is open to the atmosphere through a vent formed in the valve casing 74 so that an atmosphereic pressure is constantly developed in the atmospheric chamber 76.

On the other hand, the vacuum modifier valve unit 72 comprises a valve casing 90 which is formed with a variable-volume air chamber 92 which is defined in part by a flexible diaphragm 94 secured along its perimeter to the valve casing 90. A constant vacuum passageway 96 provided with a flow restriction or orifice 98 is open at one end thereof into the air chamber 92 toward the diaphragm 94 and is open at the other end thereof to the vacuum chamber 78 of the vacuum regulator valve unit 70 as shown. The diaphragm 94 of the vacuum modifier valve unit 72 has securely attached thereto a generally disc-shaped, ferromagnetic valve element 100 which is axially movable with the diaphragm 94 into and out of a position closing the constant vacuum passageway 96 at its leading end in the air chamber 92.

The vacuum modifier valve unit 72 further comprises a stationary solenoid unit including a solenoid coil 102 fixedly positioned opposite to the air chamber 92 across the diaphragm 94 so as to be capable of forcing the valve element 100 to move away from the above mentioned position thereof when the solenoid coil 102 is energized. The constant vacuum passageway 96 communicates with the vacuum chamber 52 of the exhaust recirculation rate control valve assembly 50 through a control vacuum passageway 104 which leads from the orifice 98 and which is open at the end of the constant vacuum passageway 96 into the air chamber 92 of the vacuum modifier unit 72. On the other hand, the air chamber 92 of the vacuum modifier valve unit 72 is in constant communication with a suitable portion of the air induction passageway in the mixture supply system upstream of the throttle valve 30 such as, for example, a portion of the air induction passageway intervening between the air cleaner 28 and the throttle valve through an air passageway 106 as shown. As well known in the art, an air pressure close to an atmospheric level constantly prevails in the air intake assembly 24 upstream of the throttle valve 30 throughout operation of the engine.

When the engine is in operation, atmospheric air is admitted through the air passageway 106 into the air chamber 92 of the vacuum modifier valve unit 72 and, on the other hand, a vacuum constantly developed in the mixture supply system downstream of the throttle valve 30 is introduced by way of the input vacuum passageway 82 into the vacuum chamber 78 of the vacuum regulator valve unit 70. If, in this instance, the solenoid coil 102 of the vacuum modifier valve unit 72 happens to remain de-energized, the ferromagnetic valve element 100 supported by the diaphragm 94 is held in the previously mentioned position closing the constant vacuum passageway 96 at its end in the air chamber 92 so that the vacuum developed in the vacuum chamber 78 of the vacuum regulator valve unit 70 is permitted to extend through the orifice 98 in the constant vacuum passageway 96 and through the control vacuum passageway 104 into the vacuum chamber 52 of the exhaust recirculation rate control valve assembly 50. The vacuum developed in the vacuum chamber 78 of the vacuum regulator valve unit 70 acts on the diaphragm 80 and urges the diaphragm to move in a direction to contract the vacuum chamber 78, viz, to move the valve element 84 into the position closing the input vacuum passageway 82 at its leading end in the vacuum chamber 78 against the force of the compression spring 86. When the vacuum in the vacuum chamber 78 reaches such a level as to overcome the opposing force of the spring 86, the valve element 84 is moved into the position closing the input vacuum passageway 82. If, under these conditions, the solenoid coil 102 of the vacuum modifier valve unit 72 is energized and causes the associated valve element 100 to move away from the position closing the constant vacuum passageway 96, then atmospheric air is admitted into the passageway 96 from the air chamber 92 and further past the orifice 98 into the vacuum chamber 78 of the vacuum regulator valve unit 70. Introduction of atmospheric air into the vacuum chamber 78 of the vacuum regulator valve unit 70 causes reduction of the vacuum in the vacuum chamber 78 and allows the diaphragm 80 of the valve unit 70 to be moved by the force of the compression spring 86 in a direction to move the valve element 84 away from the position closing the leading end of the input vacuum passageway 82. The input vacuum passageway 82 being thus allowed to be open into the vacuum chamber 78 of the vacuum regulator valve unit 70, the vacuum developed in the mixture supply system downstream of the throttle valve 30 is for a second time permitted to extend through the input vacuum passageway 82 into the vacuum chamber 78 of the vacuum regulator valve unit 70, giving rise to an increase in the vacuum in the vacuum chamber 78. The diaphragm 80 of the vacuum regulator valve unit 70 responds to the increased vacuum in the vacuum chamber 78 and maintains the valve element 84 in the position closing the leading end of the input vacuum passageway 82 until the vacuum in the vacuum chamber 78 is reduced by the atmospheric air from the air chamber 92. The vacuum regulator valve unit 70 is, thus, adapted to develop in the vacuum chamber 78 thereof a substantially constant vacuum which is determined by the force of the spring 86 or, more exactly, the difference between the respective forces of the springs 86 and 88 and the pressure and vacuum acting areas of the diaphragm 80.

The substantially constant vacuum thus developed in the vacuum chamber 78 of the vacuum regulator valve unit 70 is extended through the orifice 98 in the constant vacuum passageway 96 and is reduced by the atmospheric air which is admitted into the passageway 96 from the air chamber 92 of the vacuum modifier valve unit 72 past the valve element 100. The degrees to which the constant vacuum is to be reduced are dictated by the flow rates of the atmospheric air admitted from the air chamber 92 of the vacuum modifier valve unit 72 into the constant vacuum passageway 96 and, accordingly, by the cycles in which the solenoid coil 102 of the valve unit 72 is energized and de-energized periodically.

The vacuum thus reduced or modified by the vacuum modifier valve unit 72 is introduced through the control vacuum passageway 104 into the vacuum chamber 52 of the exhaust recirculation rate control valve assembly 50. The vacuum developed in the vacuum chamber 52 acts on the diaphragm 56 and urges the diaphragm to deform in a direction to contract the vacuum chamber 52 against the force of the compression spring 64. As the diaphragm 56 is moved in this direction, the valve element 60 carried at the leading end of the valve stem 62 extending from the diaphragm 56 is axially moved away from the position closing the exhaust gas recirculation passageway 46 and gives rise to an increase in the flow rate of exhaust gases through the valve chamber 58. Thus, the higher the vacuum in the vacuum chamber 52, the higher the exhaust gas recirculation rate through the valve chamber 58 and, on the contrary, the lower the vacuum in the vacuum chamber 52, the lower the exhaust gas recirculation rate through the valve chamber 58. The exhaust recirculation rate determined by the recirculation rate control valve assembly 50 is in this fashion variable with the magnitude (in absolute value) of the vacuum developed in the vacuum chamber 52 of the valve assembly 50 and is accordingly dictated by the duty factor of the pulse signals to be supplied to the solenoid coil 102 of the vacuum modifier valve unit 72.

Figure 2:
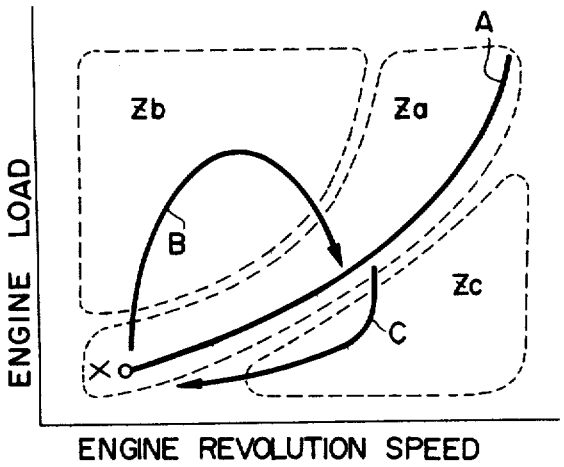
FIG. 2 is a graph showing accelerating, decelerating and constant-speed operating ranges of an internal combustion engine in terms of engine speed and air induction rate as determined in the microcomputer incorporated in the embodiment illustrated in FIG. 1.

FIG. 2 shows load-revolution speed characteristics of an internal combustion engine. The load-revolution speed characteristics herein shown are used for the programming of a microcomputer in which a collection of table data representing desired exhaust gas recirculation rates is to be stored.

In the graph of FIG. 2, point X is indicative of an idling condition of an internal combustion engine. During constant-speed operation of the engine, the relationship between the revolution speed of the engine and the load applied to the engine varies as indicated by curve A which is commonly called the road-load curve. Under accelerating an decelerating conditions of the engine, the relationship between the two operational parameters varies as indicated by curves B and C, respectively.

On the other hand, it is well known that internal combustion engines in general tend to produce more nitrogen oxides ($NO_x$) in the exhaust gases therefrom under accelerating conditions than during other modes of operation of the engines. For the purpose of reducing the concentration of nitrogen oxides in the exhaust gases from an internal combustion engine, it is therefore advantageous to recirculate more exhaust gases under accelerating conditions of the engine, viz, under conditions represented by zone Zb containing more of the curve B than under other conditions.

In conventional computer-controlled exhaust gas recirculation systems of internal combustion engines, the exhaust gas recirculation rates are controlled in such a manner that the higher recirculation rates are achieved under conditions represented by zone Zb than under constant-speed conditions represented by zone Za. Under constant-speed operating conditions of the engines, exhaust gases are thus recirculated at reduced rates as compared with the recirculation rates achieved under accelerating conditions of the engine so as to enable the engines to produce stabilized combustion performance under constant-speed operating conditions thereof. During deceleration of the engines as indicated by zone Zc in FIG. 2, the recirculation of exhaust gases is interrupted to avoid deterioration of the combustion performance of the engines because the recirculation of exhaust gases tends to result in unstable combustion of the air-fuel mixture in the engine cylinders and accordingly in production of increased amounts of hydrocarbons and carbon monoxide under decelerating conditions of the engines.

During acceleration of a vehicle on a level road surface the load-revolution speed characteristics of the engine vary as indicated by curve A and are shifted from zone Zb to zone Za in a comparatively short while. When, on the other hand, the vehicle is ascending on a steep hill, the load-revolution speed characteristics of the engine stay in zone Zb. Under these conditions, more heat is generated in the combustion chambers of the engine and causes the temperature of the engine cooling water to rise rapidly. If exhaust gases are recirculated at high rates to the engine thus heated, the engine will be caused to overheat.

Furthermore, recirculation of exhaust gases tends to impair the combustion performance of an internal combustion engine as is well known in the art. If exhaust gases are recirculated at uncontrolled rates during hill-climbing of a vehicle when sufficient forces of inertia in the forward direction are not achieved, the recirculation of exhaust gases would result in deteriorated driveability of the vehicle and would in the worst case jeopardize the hill-climbing ability of the vehicle. The improper combustion performance caused by the recirculation of exhaust gases during hill-climbing of the vehicle will invite deterioration of the fuel economy of the engine.

To eliminate these problems encountered in prior-art computer-controlled exhaust gas recirculation systems for internal combustion engines, the present invention proposes to control the exhaust gas recirculation rate basically in such a manner as to discriminate the accelerating and hill-climbing conditions from each other depending upon the period of time after the load-revolution speed characteristics of the engine have entered the zone Zb and to thereby compensate or modify the exhaust gas recirculation rates dictated by the table data stored in a microcomputer to control the recirculation system.

In the exhaust gas recirculation system according to the present invention, the pulse signals to be supplied to the solenoid coil 102 are produced by electric control means which in the embodiment herein shown includes an electronic microcomputer schematically shown at 108 in FIG. 1.

The microcomputer 108 is adapted to operate in response to input signals representative of prescribed operational parameters of the engine and, thus, has input terminals connected to suitable sources of such signals. In the embodiment herein illustrated, these signal sources are assumed, by way of example, to comprise an engine speed sensor 110 for detecting revolution speed of the output shaft of the engine and producing an output signal Sn representative of the detected revolution speed and an air induction rate sensor 112 for detectng the induction rate of air through the mixture supply system of the engine and producting an output signal Sq representative of the detected air induction rate. The engine speed sensor 110 is shown constituted by an electromagnetic pickup counter comprising a magnetic rotor 114 rotatable with the output shaft of the engine and having south and north poles arranged alternately along the circumference of the rotor and a coil unit 116 fixedly positioned adjacent the rotor 114. The engine speeds sensor 110 is, thus, adapted to produce the output signal Sn in the form of a train of pulses at a frequency proportional to the revolution speed of the engine output shaft. On the other hand, the air induction rate sensor 112 is shown constituted by a potentiometer comprising a resistance element 118 extending in an arc and a sliding contact 120 rotatable about a fixed shaft and slidable on the resistance element 118. The sliding contact 120 of the potentiometer is ganged with an air flow meter 121 provided in the air intake assembly 24 between the air cleaner 28 and the throttle valve 30 and is rotatable with the air flow meter 121. The air induction sensor 112 is, thus, adapted to produce the signal Sq in the form of a voltage which is continuously variable with the opening degree of the choke valve 32 and accordingly the induction rate of air through the air intake assembly 24.

The signals Sn and Sq thus produced by the sensors 110 and 112, respectively, are supplied to each of a memory circuit 122 and a decision circuit 124 which form part of the microcomputer 108. The memory circuit 122 has stored therein a collection of data indicating maximum desired exhaust gas recirculation rates for various revolution speeds of the engine and various air induction rates each per single turn of the engine output shaft. In response to the signals Sn and Sq delivered from the sensors 110 and 112, respectively, the memory circuit 122 produces an output signal indicative of the exhaust gas recirculation rate which is optimum for the accelerating condition of the engine at the engine revolution speed and air induction rate represented by the particular signals Sn and Sq. The signal thus produced by the memory circuit 122 is passed to a correction circuit 126 which also forms part of the microcomputer 108.

On the other hand, the decision circuit 124 of the microcomputer 108 has stored threin a collection of data memorizing the boundary lines between the constant-speed and accelerating ranges (which correspond to the zones Za and Zb, respectively, in the graph of FIG. 2) of the operating conditions of the engine in terms of engine revolution speed and air induction rate through the mixture supply system. The decision circuit 124 is thus operative to determine the particular range in which the engine operating conditions represented by the signals Sn and Sq fed to the decision circuit 124 fall and to deliver an output signal representative of any of the two different ranges. If desired, the decision circuit 124 may be of the type which has incorporated therein a function generator adapted to generate a suitable mathematic function in accordance with which the engine operating conditions represented by the signals Sn and Sq fed to the function generator are to be categorized into either of the constant-speed and accelerating ranges.

The signals produced by the decision circuit 124 is supplied to a timer circuit 128 which is responsive to the signal representative of the accelerating range of the engine operating conditions. In the presence of the signal representing the accelerating range of the engine operating conditions, the timer circuit 128 is actuated to supply a correction signal (which may be in the form of clock pulses) to the correction circuit 126. The correction signal is delivered from the timer circuit 128 continuously or cyclically throughout the time duration of the signal produced by the decision circuit 124. In response to the collection signal thus supplied from the timer circuit 128, the correction circuit 126 produces a train of pulse signals with a duty factor corresponding to the output signal from the memory circuit 122. Under accelerating conditions of the engine, the solenoid coil 102 of the vacuum modifier valve unit 72 is supplied with pulse signals with a duty factor optimum for the accelerating conditions of the engine, viz, effective to provide the maximum exhaust gas recirculation rate optimum for the engine revolution speed and air induction rate represented by the signals Sn and Sq delivered from the sensors 110 and 112, respectively.

Figure 3:
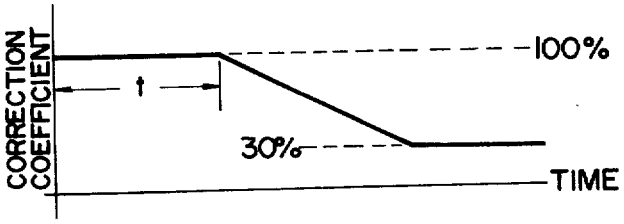
FIG. 3 is a graph showing an example of the principle on which signals representative of exhaust gas recirculation rates are to be corrected in the microcomputer in the embodiment of FIG. 1 under accelerating and constant-speed operating conditions of the engine.

When, on the other hand, the decision circuit 124 is producing a signal representative of the constant-speed or decelerating range of the engine operating conditions, there is no output signal delivered from the timer circuit 128. In the absence of an output signal from the time circuit 128, the correction circuit 126 compensates the output signal from the memory circuit 122 in such a manner that the exhaust gas recirculation rate represented by the signal from the memory circuit 122 is modified to be optimum for the constant-speed or decelerating conditions of the engine. Thus, the correction circuit 126 supplies to the solenoid coil 102 of the vacuum modifier valve unit 72 pulse signals with a duty factor which is the product of a suitable correction coefficient and the duty factor predetermined for the maximum exhaust gas recirculation rate represented by the signal delivered from the memory circuit 122. The correction coefficient may be predetermined to be 100 percent for the accelerating range of the engine operating conditions and 30 percent for the constant-speed range of the engine operating conditions as indicated in the graph of FIG. 3. In this instance, the solenoid coil 102 of the vacuum modifier valve unit 72 is energized with pulse signals having a duty factor which is 30 percent higher than the duty factor predetermined for the accelerating range of the engine operating conditions. Under constant-speed operating conditions of the engine, atmospheric air is admitted into the vacuum chamber 52 of the exhaust recirculation rate control valve assembly 50 at a rate which is 30 percent higher than the rate obtained under accelerating conditions of the engine. In other words, the exhaust gas recirculation rate achieved under constant-speed operating conditions of the engine is 30 percent lower than the recirculation rate achieved under accelerating conditions of the engine.

In the graphs of FIG. 3, the axis of abscissa stands for the lapse of time after the load-revolution speed characteristics of the engine accelerated have entered the zone Zb shown in FIG. 2. Time t indicates the point of time at which the load-revolution speed characteristics of the engine being accelerated are shifted from the zone Zb to the zone Za.

The exhaust gas recirculation rate achieved in the system hereinbefore described is, thus, increased under accelerating conditions of the engine when more nitrogen oxides tend to be contained in exhaust gases of the engine and is reduced under constant-speed operating conditions of the engine when the engine is required to provide stabilized combustion performance.

While it has been assumed that the present invention is applied to an internal combustion engine of the fuel injection type, it will be apparent that the present invention is also applicable to an internal combustion engine of the type using a carburetor as part of the mixture supply system thereof.

What is claimed is:

1. In an internal combustion engine having an air-fuel mixture supply system, an exhaust system and an exhaust gas recirculation system including exhaust gas recirculation passageway means for providing communication between the exhaust system and the mixture supply system, and valve means operative to vary the recirculation rate of exhaust gases through said passageway means depending upon a signal supplied to the valve means, the improvement comprising detecting means for detecting prescribed operational parameters of the engine and producing signals representative of the detected operational parameters, and control means comprising a decision circuit responsive to said signals for producing either of signals respectively representative of at least two predetermined load conditions of the engine, a timer circuit responsive to predetermined one of the signals from the decision circuit for producing an output signal for a period of time related to the time duration of said predetermined one of the signals from the decision circuit, and control signal delivery means responsive to the signals from said detecting means and the signal from said timer circuit for supplying to said valve means a control signal dictated by the signals from the detecting means and corrected by the signal from the timer circuit.

2. The improvement as set forth in claim 1, in which said control signal delivery means comprises a memory circuit having stored therein a collection of data representative of desired exhaust gas recirculation rates in terms of said prescribed operational parameters of the engine, said memory circuit being operative to produce an output signal representative of one of said data in response to said signals from said detecting means.

3. The improvement as set forth in claim 2, in which said control signal delivery means further comprises a correction circuit responsive to the output signal from said memory circuit for correcting the signal from the memory circuit in the presence of the signal from said timer circuit.

4. The improvement as set forth in claim 3, in which said control signal delivery means comprises a memory circuit having stored therein a collection of data representative of maximum desired exhaust gas recirculation rates in terms of said prescribed operational parameters of the engine, said memory circuit being operative to produce an output signal representative of one of said data in response to said signals from said detecting means.

5. The improvement as set forth in claim 4, in which said decision circuit is operative to produce a signal representative of a predetermined accelerating range of the operating conditions of the engine and a signal representative of a predetermined non-accelerating range of the engine operating conditions, said timer circuit being responsive to the signal representative of the accelerating range of the engine operating conditions, said correction circuit being operative to modify the output signal from said memory circuit depending upon the presence and absence of the signal from said timer circuit.

6. The improvement as set forth in claim 5, in which said correction circuit is, in the absence of the signal from said timer circuit, operative to modify the signal from said memory circuit in such a manner that the signal to be delivered from the correction circuit is representative of a predetermined fraction of the exhaust gas recirculation rate represented by the signal from the memory circuit.

7. The improvement as set forth in any one of claims 1 to 6, in which said decision circuit has stored therein a collection of data representative of said two predetermined load conditions of the engine in terms of said prescribed operational parameters of the engine.

8. The improvement as set forth in claim 5 or 6, in which said decision circuit has stored therein a collection of data representative of said accelerating range and said non-accelerating range of the engine operating conditions in terms of said prescribed operational parameters of the engine.

9. The improvement as set forth in any one of claims 1 to 6, in which said decision circuit comprises a function generator operative to generate a mathematic function for categorizing the engine operating conditions represented by said signals from said detecting means into either of said two prescribed load conditions of the engine.

10. The improvement as set forth in claim 5 or 6, in which said decision circuit comprises a function generator operative to generate a mathematic function for categorizing the engine operating conditions represented by said signals from said detecting means into said accelerating range and said non-accelerating range of the engine operating conditions.

11. The improvement as set forth in any one of claims 1 to 6, in which said detecting means comprises an engine speed sensor for detecting the revolution speed of the output shaft of the engine and an air induction rate sensor for detecting the induction rate of air through said mixture supply system.

* * * * *